US006116440A

United States Patent [19]

Zaksenberg et al.

[11] Patent Number: 6,116,440

[45] **Date of Patent: *Sep. 12, 2000**

[54] RESEALABLE THERMOFORMED CONTAINER

[75] Inventors: Issac Zaksenberg, Scotch Plains; George Neveras, Cream Ridge, both of N.J.

[73] Assignee: Colgate - Palmolive Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/742,728

[22] Filed: Nov. 1, 1996

[51] Int. Cl.[7] ..... B65B 7/28

[52] U.S. Cl. ..... 215/44; 215/6; 215/45; 215/354; 215/382; 220/521; 220/522

[58] Field of Search ..... 215/6, 42, 43, 215/44, 45, 40, 382, 354; 220/521, 522

[56] References Cited

U.S. PATENT DOCUMENTS

| | | | |
|---|---|---|---|
| 1,577,020 | 3/1926 | Hammer | 215/44 |
| 1,866,770 | 7/1932 | Hilgenberg | 215/44 |
| 3,405,831 | 10/1968 | Hudson | 215/44 X |
| 3,561,629 | 2/1971 | Turner . | |
| 4,024,952 | 5/1977 | Leitz | 220/522 X |
| 4,720,351 | 1/1988 | Flynn et al. | 220/522 X |
| 4,776,972 | 10/1988 | Barrett | 220/521 X |
| 4,854,458 | 8/1989 | Differ . | |
| 4,979,630 | 12/1990 | Rose et al. | 215/42 X |
| 5,060,813 | 10/1991 | Gollasch et al. | 215/349 |
| 5,207,341 | 5/1993 | Yeager | 215/334 |
| 5,417,337 | 5/1995 | Robbins, III | 220/354 X |
| 5,524,788 | 6/1996 | Plester | 220/522 |
| 5,549,213 | 8/1996 | Robbins, III et al. | 220/354 X |
| 5,553,727 | 9/1996 | Molinaro | 215/45 X |

FOREIGN PATENT DOCUMENTS

| | | |
|---|---|---|
| 0 612 664 | 8/1994 | European Pat. Off. . |
| WO94/08852 | 4/1994 | WIPO . |
| WO96/01212 | 1/1996 | WIPO . |

*Primary Examiner*—Stephen Cronin
*Attorney, Agent, or Firm*—Michael McGreal

[57] ABSTRACT

The present thermoformed containers are recloseable and resealable. This is accomplished primarily by providing a thermoformed container with a threaded neck and the use of a conventional type of closure on the threaded neck of the thermoformed container. The threads are on the neck and preferably also on an outwardly extending peripheral edge on the neck. This outwardly extending peripheral edge is created in thermoform molding. The neck preferably also is in the form of a two or more ply structure and in a further preferred embodiment the neck is reinforced by the closure. The closure in the embodiment of external threads on the neck has a reinforcing plug. In this embodiment the reinforcing plug fits into the neck adjacent the inner wall of the neck while the threads of the closure contact the exterior wall of the neck. In the embodiment of internal threads on the neck the closure can have a skirt which is in close contact with the exterior wall of the neck. This will likewise reinforce the neck. The neck can be of many shapes from cylindrical to approaching a rectangular shape.

11 Claims, 3 Drawing Sheets

RESEALABLE THERMOFORMED CONTAINER

FIELD OF THE INVENTION

This invention relates to a thermoformed container that can be opened and resealed. More particularly, this invention relates to a thermoformed container that has a spout dispensing end and a closure threadedly engaging and sealing the spout dispensing end.

BACKGROUND OF THE INVENTION

Thermoformed containers are relatively inexpensive to produce. However they have the disadvantages that they are difficult to fill and are not recloseable with a good seal. The latter is a distinct disadvantage when the contents of the thermoformed containers are not to be used at one time. When the product is to be dispensed in two or more portions a container must be resealable. Also the reseal feature must be a leakproof seal. This is difficult to do in view of the fact that thermoformed containers usually have thin walls. When container walls are thin and flex it is difficult to get a good seal. This is particularly the case where the walls in the area of the seal and reseal feature are thin and flex.

The prior art with regard to recloseable thermoformed containers is described in U.S. Pat. No. 3,278,085; U.S. Pat. No. 3,913,734; U.S. Pat. No. 4,209,096 and U.S. Pat. No. 5,228,782. U.S. Pat. No. 3,278,085 discloses a sachet container that is opened by removing a tear-off portion to open a nozzle. The nozzle is closed by folding over the top part of the nozzle with the folded portion held by two locking tabs.

In U.S. Pat. No. 3,913,734, the container is of the blister pack type with the backing board having a memory of its original position. The nozzle of the container is opened by bending backward the backing board. When some of the contents have been dispensed, the backing board regains its original shape closing the container. This container is improved upon in U.S. Pat. No. 4,209,906. In this patent, there is added a securing means to assure that the backing board acquires its original position and retains its original position.

U.S. Pat. No. 5,228,782 discloses another fold-over type of recloseable sachet. The nozzle is opened by the removal of a tear-off tab. The sachet is closed and locked by folding over a nozzle at an angle and inserting the end of the nozzle into a holding slit.

A locking technique of using an interfitting projection and aperture is disclosed in EP 18,118A. This can be used to secure a folded over portion to a main portion of a container.

None of these references discloses an effective recloseable feature for a thermoformed container. Further none of these thermoformed containers have an effective leakproof resealable feature, and clearly not a resealable feature which can take mishandling.

The thermoformed containers of the present invention solve the problem of providing thermoformed containers with recloseable closures where the closure will provide leakproof seals when reapplied to the thermoformed container. This thermoformed container can be used in instances where a liquid or solid is to dispensed in multiple doses over a period of time.

BRIEF SUMMARY OF THE INVENTION

This invention is directed to a recloseable and resealable thermoformed container. The thermoformed container is comprised of a first longitudinal section and a second longitudinal section. Each of these sections has an outwardly extending peripheral edge, the first longitudinal section and second longitudinal section being joined at this peripheral edge. The joined first longitudinal section and second longitudinal section is closed at one end and open at an other end.

The open end of the thermoformed container terminates in a neck. This neck has threads on at least a portion of the surface. These can be internal or external threads. Preferably also there are threads on the outwardly extending edges in the region of the neck.

The spout is recloseable and resealable by means of a threaded closure. The threads on the closure mate with the threads on the neck. The engagement of the top surface of the neck and the inner surface of the closure produces the seal.

The closure also can be a reinforcing closure. For use with external threads such a closure has a plug depending downwardly from the inner surface of the closure This plug will be adjacent to or be in contact with the inner surface of the neck. This plug serves to reinforce the neck and to assist in providing a seal.

As noted the threads on the spout can be internal or external threads. The type of threads will determine the style closure. When the threads are on the internal surface of the spout the closure will have mating threads on an external surface. Also the closure can have a cylindrical skirt that extends downward from the closure top surface and in close proximity to the exterior surface of the neck to reinforce the neck. When the threads are on an external surface the closure will have threads on an inner surface of the closure sidewall. Also preferably the closure will have a plug extending downwardly from the inner surface to reinforce the wall of the container neck.

In an additional embodiment the thermoformed container is made to have a reinforced neck by means of the material in the neck being of a two-ply or more structure. This is accomplished by the sheets of material forming the container being of a two-ply or more structure in the neck region of the container.

These thermoformed containers can be filled in the same manner as conventional bottles, and used in the same manner as conventional bottles. This provides a user friendly container to consumers at a decreased cost.

DETAILED DESCRIPTION OF THE INVENTION

The recloseable and resealable thermoformed container will be described in more detail with reference to the figures. These figures set out the preferred embodiments of the invention.

Figure 1:
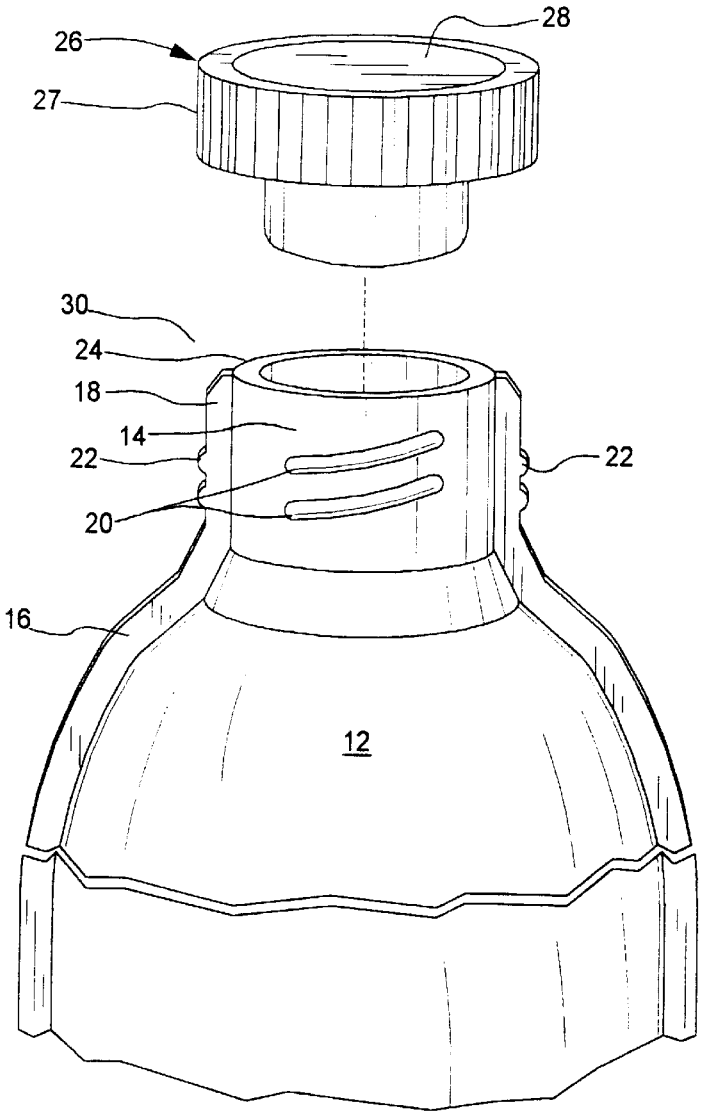
FIG. 1 is a front elevation view of a recloseable thermoformed container.

FIG. 1 shows a thermoformed container in a front elevational view. The container 12 has a surrounding outwardly extending edge 16 and a container neck 14. The neck 14 has an outwardly extending edge 18. The neck also has threads 20 with these threads aligned with threads 22 on the outwardly extending edge 18. The upper edge 24 of neck 14 is preferably planar since this upper edge will form a seal with the inner lower surface of a closure.

This container 12 is closed by means of closure 26 which has a top surface 28 and a depending cylindrical apron 27. The outer surface of this apron preferably is serrated for ease of gripping. Depending from the inner surface of the closure and spaced from cylindrical apron 27 is a cylindrical reinforcing plug 30 which fits inside container neck 14 and reinforces this part of the container.

Figure 2:
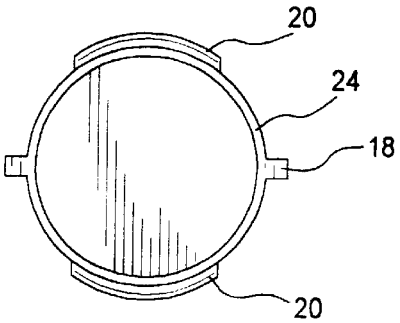
FIG. 2 is a top plan view of the neck of the bottle of FIG. 1.
Figure 3:
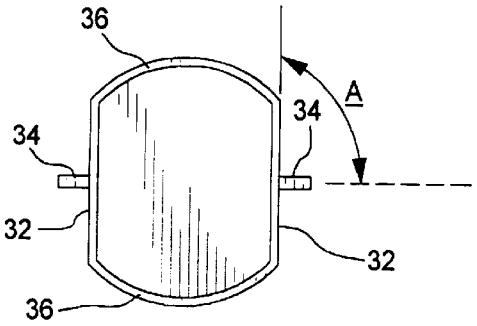
FIG. 3 is a top plan view of an alternate container neck.

FIG. 2 is a top plan view of the neck 14 of the container of FIG. 1. The threads 20 are better seen in this view. FIG. 3 discloses a variation on the neck of FIG. 1. This neck has sides 32 which have a slight curve and curved sides 36. Extending from curved sides 32 is outwardly extending edge 34. Angle A as shown in the figure is greater than 90°, and preferably is about 93° to about 105°. A more preferred angle is about 97°.

Figure 4A:
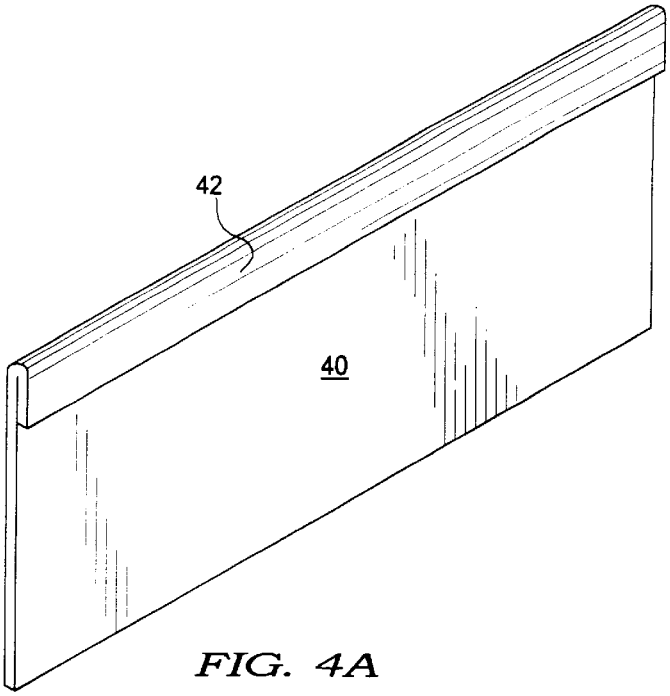
FIG. 4A is a perspective view of the a sheet of plastic to make a thermoformed container.

FIG. 4A shows plastic sheet 40 which is used to make the longitudinal sections that comprise the thermoformed containers. Two sheets are used to form a container. The upper part of the sheet is doubled over to form a second layer 42. This can be of any multilayer structure. This part of the sheet will form the container neck. The thermoformed containers in one embodiment are made by forming two sheets of plastic into a hollow body. The edges are sealed and the sheets formed to the shape of the mold, preferably by placing the sheets in a mold and blowing heated air into the mold until the sheets of plastic acquire the shape of the mold. The edges of the sheets are bonded at this time to form the outwardly extending edge. The outwardly extending edges when sealed complete the formation of the hollow body container.

Figure 4B:
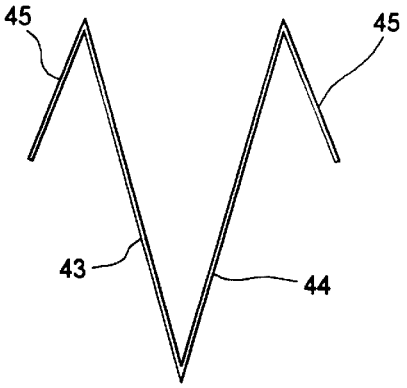
FIG. 4B is a side elevational view of a single folded sheet of plastic which forms the complete container

FIG. 4B shows a sheet of plastic that is V-shaped with legs 41 and 43. Each of the legs is overlapped to an extent by segments 45. In this embodiment only one folded sheet is used to make the thermoformed container. The fold will be at the bottom of the container with th overlap segments forming the reinforced top part of the thermoformed container. The advantage of the use of this single sheet technique is that there will be no extending edge at the bottom of the container. In this way the container can stand on the bottom in the same manner as other containers.

Thermoforming can be used to produce thin walled hollow bodies. In the present instance it is preferred that the body portion of the container be thin walled, but the neck portion have a thicker wall. The walls must have a sufficient integrity so as not to deform when the closure is applied onto or removed from the container. Also it must not deform during handling and storage. If it deforms during handling and storage the container will be prone to leaking. It is for this reason that the upper portion of sheet 40 is in a two ply structure 42. Here the upper part is folded over the lower part. This part 42 in making the present containers will be the neck 14 of the containers. Although shown as two-ply this can be a three or more ply section by a further folding over of the upper section of sheet 40.

Figure 5:
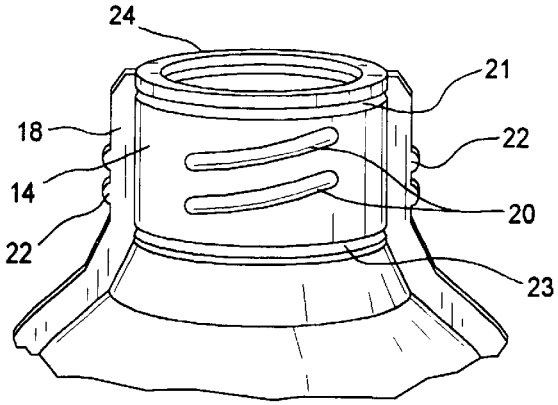
FIG. 5 is an elevational view of a thermoformed container with seal ribs.

FIG. 5 is a view of a neck of a container where in addition to threads 20 there are ribs 21 and 23 which are designed to contact the surface of the closure and to produce a better seal. In addition these ribs due to their shape will provide some stiffening reinforcement for the neck 14 of the container.

Figure 6:
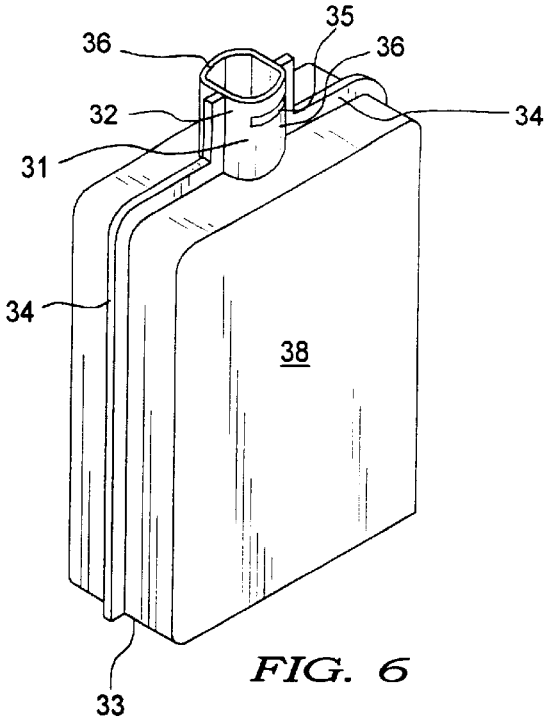
FIG. 6 is an elevational view of a thermoformed container having a neck as in FIG. 3.

FIG. 6 is a perspective view of a bottle which uses the container neck of FIG. 3. This figure shows thermoformed container 38 with neck 31. The neck has sides 32 and 36. Outwardly extending edge 34 essentially surrounds the container except for the bottom edge 33. There is no outwardly extending edge on the bottom of the container so that the container can stand on its bottom surface. Also in this view there is shown only a rib 35 for securing a closure. A seal is accomplished by the contact of upper edge 37 and the inner surface of a closure. The rib 35 will fit into a recess in the closure to provide a secure attachment of the closure to the container.

Figure 7:
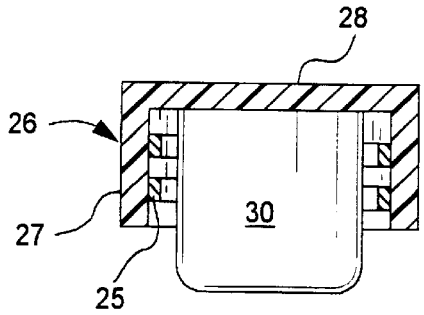
FIG. 7 is a sectional view of the closure of FIG. 1.

FIG. 7 is a sectional view of the closure of FIG. 1. This view shows the structure of reinforcing plug 30 of the closure along with threads 25 for attachment to the container.

Figure 8:
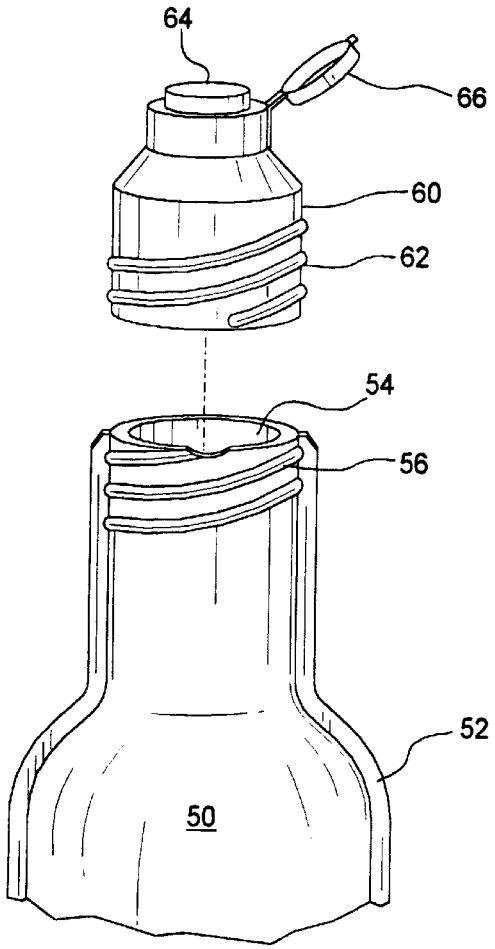
FIG. 8 is an elevational view of a dual chamber thermoformed container.

FIG. 8 discloses a dual chamber thermoformed container 50 which has a peripheral edge 52 and opening 54. Interior threads 56 accept the insert 60. This insert has threads 62 and opening 64 closed with closure 66. This insert 60 is a container and a closure. Threads 62 of the insert are accepted into threads 56 of the container.

Thermoformed containers can be formed from any plastics that can be molded using heat. Suitable plastics are polystyrene, high impact strength polystyrene, high density polyethylene high melt strength polypropylene, acrylonitrile butadiene styrene resins and modified polyacrylonitrile resins such as Barex resins. The container described in the figures can be readily sealed, opened and resealed. This is a very useful feature. Further the outwardly extending edge besides providing some strength to the container also contains threads to secure a closure. These threads aid the main threads on the container neck. In addition the use of a closure with a downwardly depending plug also serves to reinforce the neck of the container.

The invention has been described in its preferred embodiments. There are modifications that can be made to the concepts of these embodiments. However, such modifications are considered to be within the embodiments of the present thermoformed containers.

What is claimed is:

1. A plastic thermoformed container comprising a separate first thermoformed longitudinal section and a separate second thermoformed longitudinal section, an outwardly extending edge along a periphery of each of said longitudinal sections, said first longitudinal section and said second longitudinal section bonded together along said outwardly extending edge and forming a closed lower end and an open upper end, said open upper end terminating in a neck, said neck and said outwardly extending edge in the area of said neck having threads on the exterior thereof, a closure threadedly attached to the threads of said neck, said closure having a plug depending from an inner surface thereof, said plug being in a close engagement with a substantial portion of the inner surface of said neck to thereby reinforce said neck.

2. A thermoformed container as in claim 1 wherein said closure is a hollow body container.

3. A thermoformed container as in claim 1 wherein said neck has at least one rib thereon.

4. A thermoformed container as in claim 1 wherein said neck is comprised of at least a two-ply structure of a sheet material.

5. A thermoformed container as in claim 1 wherein said first longitudinal section and said second longitudinal section extend to comprise said neck.

6. A thermoformed container as in claim 5 wherein said outwardly extending edge of said first longitudinal section and said second longitudinal section extends into said neck whereby said neck is thereby reinforced.

7. A thermoformed container as in claim 6 wherein said outwardly extending edge has threads thereon.

8. A plastic thermoformed container comprising a separate first thermoformed longitudinal section and a separate second thermoformed longitudinal section, and outwardly extending edge along the periphery of each longitudinal section, said first longitudinal section and said second longitudinal section bonded together along said outwardly extending edge forming a closed lower end and an open upper end, said open upper end terminating a said neck is comprised of at least a two ply structure of a sheet of material that comprises said first longitudinal section and said second longitudinal section and said edge is comprised of at least a four-ply structure of a sheet of material that comprises said first longitudinal section and said second longitudinal section.

9. A thermoformed container as in claim 8 wherein said neck is comprises of at least a two-ply structure of a sheet material.

10. A thermoformed container as in claim 8 wherein said closure has means to reinforce said neck.

11. A thermoformed container as in claim 10 wherein said reinforcing means is a plug depending downwardly from said closure and into said container.

* * * * *